US006329930B1

(12) United States Patent
Parsadayan

(10) Patent No.: US 6,329,930 B1
(45) Date of Patent: Dec. 11, 2001

(54) METHOD AND APPARATUS FOR DETECTION OF A BREACH OF A SECURITY GATE

(76) Inventor: Alex M. Parsadayan, 10 Ebony Clade, Laguna Niguel, CA (US) 92677

( * ) Notice: Subject to any disclaimer, the term of this patent is extended or adjusted under 35 U.S.C. 154(b) by 0 days.

(21) Appl. No.: 09/422,685

(22) Filed: Oct. 21, 1999

(51) Int. Cl.[7] ..... G08G 1/01

(52) U.S. Cl. ..... 340/933; 340/937; 340/540; 340/541; 348/149

(58) Field of Search ..... 340/540, 541, 340/937, 933, 928, 905; 235/384, 380, 379; 348/148, 149

(56) References Cited

U.S. PATENT DOCUMENTS 5,101,200 * 3/1992 Swett ..... 340/825.54
5,204,675 * 4/1993 Sekine ..... 340/933
5,323,151 * 6/1994 Parsadayan ..... 340/933
5,353,021 * 10/1994 Toyama ..... 340/937
5,392,034 * 2/1995 Kuwagaki ..... 340/933
5,729,101 * 3/1998 Richmond et al. ..... 318/282
5,805,209 * 9/1998 Yuge et al. ..... 340/937
5,946,660 * 8/1999 McCarty et al. ..... 705/380

* cited by examiner

*Primary Examiner*—Jeffery A. Hofsass
*Assistant Examiner*—Daniel Prévil

(57) ABSTRACT

A security gate breach detection and reporting system is disclosed, which includes a breach detector responsive to the simultaneous receipt of signals from the security gate indicative of a breach, and adapted to generate an imaging control signal; at least one digital image producing device at the location of the security gate connected to the imaging control signal and adapted to produce image data responsive to receipt of the imaging control signal; a communication unit responsive to the breach detector and in data contact with the at least one image producing device, directly or through the breach detector, and, responsive to a signal from the breach detector, adapted to communicate image data to a remote location; and, wherein the signals from the security gate comprise signals indicating that the security gate is in the closed position and a vehicle is passing through the gate area, or signals indicating that the security gate has not returned to the closed position and a second vehicle is passing through the gate area.

16 Claims, 1 Drawing Sheet

METHOD AND APPARATUS FOR DETECTION OF A BREACH OF A SECURITY GATE

FIELD OF THE INVENTION

The present invention relates to security gates and to a method and apparatus for detection and reporting of a breach of the security gate in real time.

BACKGROUND OF THE INVENTION

Security gates are well known in the art, particularly those that control ingress and egress from parking lots and parking structures. These gates typically are operated by the use of some access card, remote control device, keypad, telephone entry system or other electronic access control, or by the payment of a fee, for example a parking fee or a road toll. Often the gate is remotely located and not manned, or at least not manned twenty-four hours a day seven days a week. A problem exists in the art where such gates are breached by an intruder without authorized access or someone departing without paying the appropriate fee. The gates are typically made of metal, wood or plastic so that a vehicle can easily drive through the gate, breaking off the gate. Even more heavy duty metal gates and roll-up doors and the like can be breached in this manner with a large enough vehicle. When this happens, known gates have been adapted to set off an alarm. In some cases surveillance cameras are located near the gate to record such events. In the case of remotely located gates and off-hours intrusions, the camera may not have enough recording capacity to still have on the recorded video the breach and/or the breacher is long gone before the tape is viewed. Another issue that needs addressing is the situation where a tail-gaiter behind an authorized entrant clears through the gate before is closes.

Upon a valid authorization, some form of a controller, e.g., a microcomputer or microcontroller, opens the gate. This allows the vehicle to ingress or egress and in so doing the vehicle passes over or by a sensor, typically a magnetic loop, but it could be a must come down before the loop sensor senses a second vehicle passing the loop sensor.

There exists a need in the art to better monitor gate intrusions in real time in order to better identify and apprehend the perpetrator.

SUMMARY OF THE INVENTION

A method and apparatus for detecting the breach of a security gate senses the gate in the closed position while the vehicle is sensed in the exiting position, or senses the gate not having returned to the closed position before a second vehicle passes the loop sensor. In either case, the gate is being breached. The present invention initiates the electronic photography of the perpetrator and the perpetrator's vehicle and license plates. An electronic mail message addressed to the owner of the facility, the appropriate police department and whatever other security company or agency is appropriate is opened and transmitted along with the electronic images within or as an attachment to the electronic mail mess age.

DETAILED DESCRIPTION OF THE PREFERRED EMBODIMENT(S)

Figure 1:
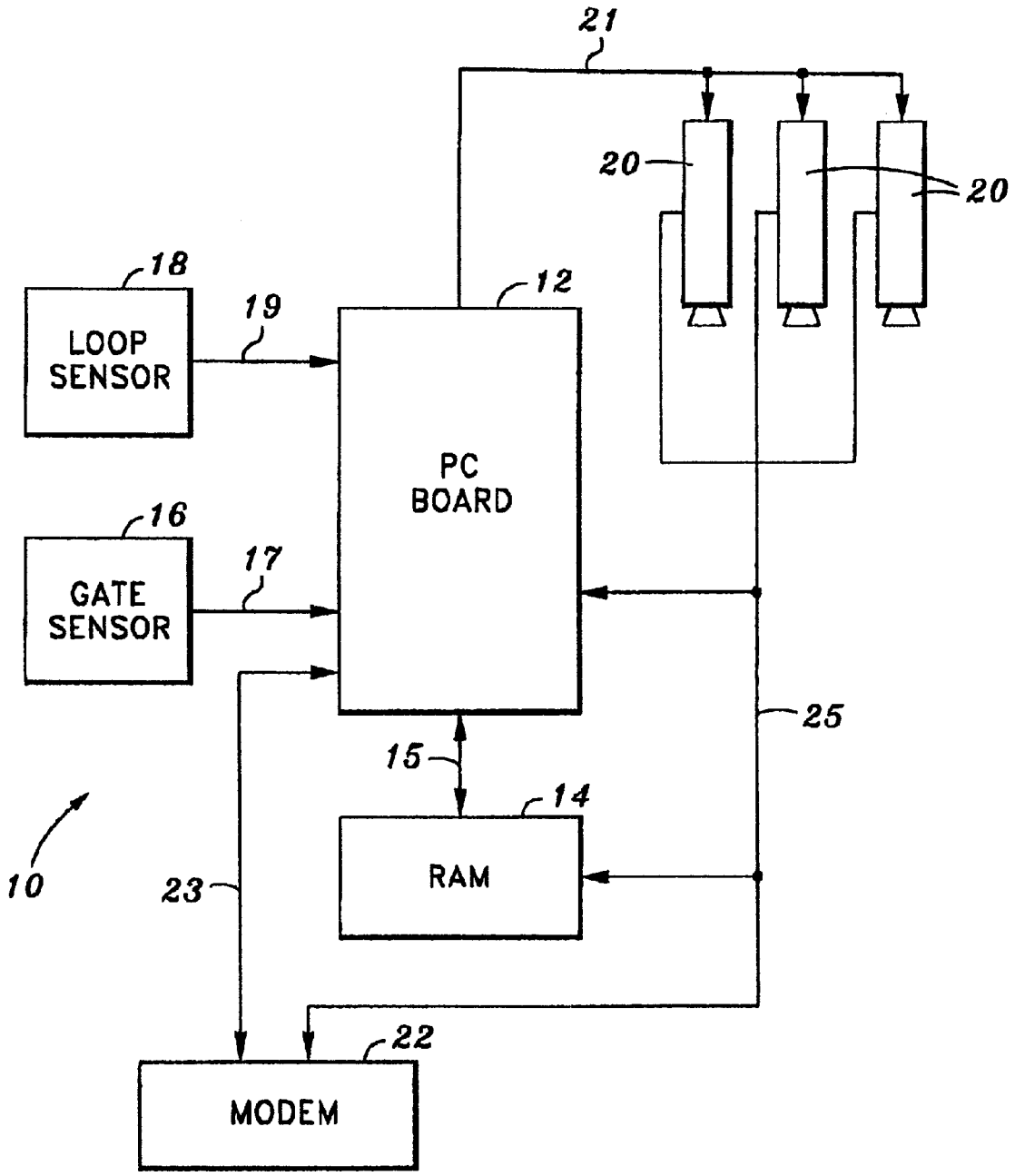
FIG. 1 shows a schematic block diagram of the present invention.

Turning now to FIG. 1 there is shown a schematic block diagram of the pre sent invention. The security gate breach detection and reporting system 10 of the present invention includes a PC board 12. The PC board 12 can be any of a wide variety of PC boards 12 containing a microprocessor (not shown) or microcontroller (not shown), e.g., an X86, a Pentium, a Celeron or other Intel microprocessor or compatible, or a Motorola 6800 microprocessor, or an Alpha microprocessors formerly made by Digital Equipment Corporation (now part of Compaq), or a Sun microprocessor, or the like, and equivalents or compatibles. The PC board 12 has associated with it a Random Access Memory ("RAM") 14, which is connected to the PC board 12 by a memory bus 154. It will be understood by those skilled in the art that the microprocessor/microcontroller on the PC board 12 may have internal or external RAM on the PC board itself which may act as a cache memory or act as both cache memory and part or all of main memory, so that the RAM 15 may be supplemented by or replaced by RAM on the PC board or within the microprocessor or a combination of the two. As semiconductor manufacturing technologies continue to improve there will eventually be enough RAM as cache or main memory on the microprocessor chip itself, or in a multi-chip package, such that a RAM off of the PC board or even outside of the microprocessor's I.C. package will not be necessary to carry out the present invention.

The system 10 also includes a gate sensor 16 connected to the PC board 12 by a bus 17 and a loop sensor 18 connected to the PC board by a bus 19. The gate sensor 16 produces a signal when the gate is in the down position. The loop sensor 18 produces a signal when a vehicle is in the gate area, i.e., has started to pass through, but has not yet passed through the gate. The loop sensor 18 can be one of a variety of sensors of the magnetic, optical pressure or other variety of sensors or combinations of sensors, well known in the art, which sense the presence of a vehicle which has begun ingress or egress through the gate but has not cleared through the gate.

The microprocessor/microcontroller on the PC board 12 is programmed to sense the presence of the gate down signal and the loop sensor indication of an ongoing passage through the gate, or, alternatively, a second passage through the gate is ongoing before the gate has returned to the closed position. Either case is an indication that the gate is currently being breached. The system 10 also includes a plurality of cameras 20, which are controlled by the microprocessor/microcontroller on the PC board 12 over a control bus 21 to begin taking pictures of strategic locations around the gate area, e.g., the driver's side driver's seat location of the vehicle, the front and/or rear license plate locations on the vehicle, an overall shot of the gate area showing the bulk of or all of the vehicle as it passes through, etc. Therefore, when the microprocessor/microcontroller receives an indication of a gate breach from the gate sensor and loop sensor both being on or the loop sensor being on again before the gate sensor goes of the microprocessor activates all of the cameras 20 or some of the cameras 20. It will be understood that depending upon the type of logic used the gate sensor may be "off" when the gate is closed and the loop sensor may be "off" when a vehicle passage is occurring, in which event the logic is adapted to respond accordingly to the indicated condition and/or its inverse "on" condition.

The cameras 20 may be any of a vide variety of known digital video cameras, which employ, e.g., Charged Couple Device ('CCD") digital imaging integrated circuits or CMOS imaging microcircuits. They may also include strategically placed integrated circuit CCD or CMOS imagers without a camera housing and lens arrangement, e.g., having a micro-lens built right into the integrated circuit package, as are well known in the art. In the latter case, the I.C. imagers 20, along with associated microprocessors/microcontrollers, Digital Signal Processor(s) ("DSPs"}or the like for signal processing of the video image data sensed by the integrated circuit imager (which may be inside of the housing of commercially available digital cameras) may be a part of the PC board 12 itself. Alternatively these miniaturized video imagers/cameras may be mounted on or around the housing (not shown) in which the PC board 12 is contained. The PC board 12 housing (not shown) is adapted to conveniently be mounted on or around the gate operating mechanism (not shown).

The cameras/imagers 20 provide digital video data over a data bus 25 to the microprocessor/microcontroller on the PC board 12 and to the RAM 14. It will be understood by those skilled in the art that the microprocessor/microcontroller on the PC board 12 may control the processing of the data from the integrated circuit imagers 20 if such are substituted for the cameras 20 or may process the data received from the cameras 20 themselves. The data which arrives from the cameras 20 may be raw digital video or compressed video data, e.g., compressed in MPEG 1 or MPEG 2 format or other suitable format. The data may be unprocessed image data received from a CCD or CMOS imager substituted for the camera 20, e.g., on an image pixel by pixel basis. In the former case, the microprocessor/microcontroller may do some additional processing of the video data, e.g., selecting some frames to send and/or to store in memory. In the later case the microprocessor alone, or with the aid of a coprocessor and/or a DSP may construct raw digital video data from the imager pixel data and may also compress the raw digital video data into, e.g., MPEG 1 or MPEG 2 format or other suitable format. Video data may be stored in the RAM 14 for purposes of enabling data processing of the video data by the microprocessor/microcontroller and/or for storage prior to transmission.

The microprocessor/microcontroller on the PC board 12 is also connected to a modem 22. The modem 22 can be any of a wide variety of switched telephone network, XDSL, wireless, cable, satellite or the like modems, well known in the art. The modem 22 can be a standalone unit as shown in FIG. 1. It will also be understood that the modem 22 can be part of the integrated circuitry mounted on the PC board 12 or a so-called soft-modem running in software on the microprocessor/microcontroller on the PC board 12. In the latter event the element 22 would simply be composed of some interface to the data transmission line, e.g., a digital to analog converter an optical interface or the like, with the modem communications protocols and data processing occurring in the microprocessor/microcontroller. The modem 22 can be connected to the Internet, either at all times or in response to a signal from the microprocessor/microcontroller to begin communicating due to a security breach. The communication can be directly to a web page of the owner, law enforcement and/or security force. The image data can be sent as part of or as an attachment to an E-Mail message. The transmission can also be modem to modem over the Internet or other communication link, with the remote modem connected to a local microprocessor/microcontroller capable of performing some or all of the above noted processing of the video image data from the camera 20 or other digital imager.

In operation, when the cameras/imagers 20 are activated, the video data in whatever form can be ported directly to the modem 22 over bus 25. The microprocessor/microcontroller performs the modem 22 communication functions or sets up the modem 22 to perform those functions. The modem 22 transmits image or video data, compressed or un-compressed, as is selected by the microprocessor/microcontroller and according to the capabilities of the recipients to un-compress and/or otherwise process raw digital video data and/or perhaps to construct digital video data from pixel image data. Depending upon the source and type of image data (from a digital video camera or from integrated circuit imaging devices) and the abilities of the integrated circuits to do some image data processing, the transmission over the modem 22 may come directly from the camera/imagers 20 over bus 25 or from the microprocessor/microcontroller on the PC card 12, over bus 23, or from the RAM 14 under the control of the microprocessor/microcontroller over the bus 23. In addition if it is desired to only send certain selected frames from the video data or only selected ones of the camera views, depending upon some processing of the video images contained in the pictures represented in the frames of digital video data, the microprocessor/microcontroller may perform these functions on the video image data and pass the modified video data to the modem 22 for transmission.

The recipients of the transmitted signal can be the owner of the property protected by the security gate, the local law enforcement authorities, the company or contracted security force, etc. The images can be sent to a web site for the owner, the law enforcement authority or the security force.

Receipt of such imagery in real time over the Internet or modem to modem over the appropriate communications link or through an Intranet will enable real time response and the utilization of the imagery to seek out the perpetrator of the breach and/or the downloading of image data stored at the remote location as the result of activation of the cameras.

The present invention has been described in general terms with reference to certain preferred embodiments. The invention is not to be interpreted to be limited to the preferred embodiments disclosed. Those skilled in the art will understand that there are many variations and modifications of the preferred embodiments, which still will come within the expressed features claimed, and their equivalents.

I claim:

1. A security sate breach detection and reporting system comprising:

a breach detector responsive to the simultaneous receipt of signals from the security gate indicative of a breach, and adapted to generate an imaging control signal;

at least one digital image producing device at the location of the security gate connected to the imaging control signal and adapted to produce image data responsive to receipt of the imaging control signal;

a communication unit responsive to the breach detector and in data contact with the at least one image producing device, directly or through the breach detector, and, responsive to a signal from the breach detector, adapted to communicate image data to a remote location; and wherein the signals from the security gate comprise signals indicating that the security gate is in the closed position and a vehicle is passing through the gate area, or signals indicating that the security gate has not returned to the closed position and a second vehicle is passing through the gate area.

2. The apparatus of claim 1 further comprising:

the breach detector comprises a data processor; and the communication unit comprises a modem.

3. The apparatus of claim 2 further comprising:

the image producing device comprises a digital video camera or a digital imager located in the vicinity of the breach detector.

4. The apparatus of claim 1 wherein the communication unit is in communication contact with a remote location over the Internet.

5. The apparatus of claim 4 wherein the image data is included in or as an attachment to an E-mail message.

6. A security gate breach detection and reporting system comprising:

a breach detector means, responsive to the simultaneous receipt of signals from the security gate indicative of a breach, for generating an imaging control signal;

at least one digital image producing means, a the location of the security gate and responsive to the image control signal, for producing image data responsive to receipt of the imaging control signal;

a communication means responsive to the breach detector and in data contact with the at least one image producing means, directly or through the breach detector, and, responsive to a signal from the breach detector, for communicating the image data to a remote location; and wherein the signals from the security gate comprise signals indicating that the security gate is in the closed position and a vehicle is passing through the gate area, or signals indicating that the security gate has not returned to the closed position and a second vehicle is passing through the gate.

7. The apparatus of claim 6 further comprising:

the breach detector means comprises a data processing means; and the communication means comprises a modem.

8. The apparatus of claim 6 further comprising:

the image producing means comprises a digital video camera or a digital imager located in the vicinity of the breach detector.

9. The apparatus of claim 8 further comprising:

the image producing means comprises a digital video camera or a digital imager located in the vicinity of the breach detector.

10. The apparatus of claim 6 wherein the modem is in communication contact with a remote location over the Internet.

11. The apparatus of claim 10 wherein the image data is included in or as an attachment to an E-mail message.

12. A method of detection of and reporting of a security gate breach comprising:

detecting a breach of, and generating an imaging control signal responsive to the breach, producing image data from at least one digital image producing means, at the location of the security gate, responsive to the imaging control signal, communicating th e image data from the at least one image producing means to a remote location over a communication means in data contact with the at least one image producing means, directly or through the breach detector, responsive to a communication initiation signal from the breach detector; and wherein the step of detecting includes detecting that the security gate is in the closed position and a vehicle is passing through the gate area, or that the security gate has not returned to the closed position and a second vehicle is passing through the gate.

13. The apparatus of claim 12 further comprising:

the step of detecting is carried out in a microprocessor; and the step of communicating is carried out through a modem.

14. The apparatus of claim 12 further comprising:

the image producing means comprises a digital video camera or a digital imager located in the vicinity of the breach detector.

15. The apparatus of claim 12 wherein the modem is in communication contact with a remote location over the Internet.

16. The apparatus of claim 15 wherein the image data is included in or as an attachment to an E-mail message.

* * * * *